US006111396A

United States Patent [19]

Lin et al.

[11] Patent Number: 6,111,396

[45] Date of Patent: Aug. 29, 2000

[54] ANY VALUE, TEMPERATURE INDEPENDENT, VOLTAGE REFERENCE UTILIZING BAND GAP VOLTAGE REFERENCE AND CASCODE CURRENT MIRROR CIRCUITS

[75] Inventors: Meng-Jyh Lin, Kaoshung; Yen-Hong Wu, Hsinchu; Ming-Tsann Chen, Hwaliang, all of Taiwan

[73] Assignee: Vanguard International Semiconductor Corporation, Hsinchu, Taiwan

[21] Appl. No.: 09/292,660

[22] Filed: Apr. 15, 1999

[51] Int. Cl.[7] ..... G05F 3/16

[52] U.S. Cl. ..... 323/313; 323/315; 323/907

[58] Field of Search ..... 323/312, 313, 323/314, 315, 316, 907

[56] References Cited

U.S. PATENT DOCUMENTS

| | | | |
|---|---|---|---|
| 4,525,663 | 6/1985 | Henry | 323/280 |
| 4,902,959 | 2/1990 | Brokaw | 323/314 |
| 5,168,210 | 12/1992 | Thus | 323/313 |
| 5,559,425 | 9/1996 | Allman | 323/315 |
| 5,570,008 | 10/1996 | Goetz | 323/315 |
| 5,596,265 | 1/1997 | Wrathall et al. | 323/315 |

*Primary Examiner*—Adolf Deneke Berhane
*Attorney, Agent, or Firm*—Tung & Associates

[57] ABSTRACT

A voltage reference circuit for generating various selectable voltage reference values with temperature independence is disclosed wherein a band-gap voltage reference circuit portion, that produces a temperature independent band-gap voltage reference $V_{BG}$ output, has a cascode current mirror circuit portion coupled thereto in such manner that a selectable voltage reference $V_{REF}$ is output with the temperature coefficient of the selected voltage reference canceled.

5 Claims, 1 Drawing Sheet

ANY VALUE, TEMPERATURE INDEPENDENT, VOLTAGE REFERENCE UTILIZING BAND GAP VOLTAGE REFERENCE AND CASCODE CURRENT MIRROR CIRCUITS

FIELD OF THE INVENTION

The present invention relates generally to voltage reference circuits and, more particularly, to a simplified voltage reference circuit that is capable of generating a temperature-independent, band-gap voltage reference and any other value voltage references that are temperature independent.

BACKGROUND OF THE INVENTION

At present, typical voltage reference circuits can only generate a temperature independent (TI), band-gap (BG) voltage reference having a magnitude of about 1.2 V. When another voltage value is desired or required, usually a resistor ladder which raises or lowers the band-gap reference voltage, is used to generate it; but, because resistors have a positive temperature coefficient, the generated voltage is not a TI reference voltage.

Accordingly, there is a need for a circuit that can generate temperature independent BG voltage references and any other value voltage references that are independent of the effects of temperature.

It is therefore an object of the present invention to provide a voltage reference circuit that can be used to generate various selected reference voltage values with temperature independence.

SUMMARY OF THE INVENTION

In accordance with the present invention, an improved circuit architecture is presented combining a cascode current mirror with a commonly used band-gap voltage reference circuit to cancel the temperature coefficient of the desired reference voltage. FIG. 1 is a simplified schematic of a preferred form of such a circuit arrangement exclusive of the start up circuit. The ratio of the two bipolar transistors, Q1 and Q2, and the ratio of the two resistors, R1 and R2, in the circuit arrangement are used to generate a band-gap voltage, $V_{BG}$, that is temperature independent. The cascode current mirror generates the desired voltage reference $V_{REF}$ that is also independent of the temperature coefficient of the resistors. As seen from the Figure, the band-gap voltage $V_{BG}$, and the desired reference voltage $V_{REF}$, are related by the following equations:

$$V_{BG}=V_{BE3}+V_T(\mathrm{R2}/\mathrm{R1}\times\ln M) \quad (1)$$

$$V_{REF}=V_{BG}\times\mathrm{R4}/\mathrm{R3} \quad (2)$$

where $V_{BE3}$ is the base-emitter voltage of bipolar Q3 and is the negative temperature coefficient voltage factor, $V_T$ is the positive temperature coefficient voltage factor, ln is natural logarithm, and M is the ratio of the emitter areas of bipolars Q1 and Q2.

Thus, in the improved circuit arrangement the desired reference voltage $V_{REF}$ is a function of the temperature independent band-gap voltage $V_{BG}$ and accordingly temperature independent also. Its value is a function of the ratio of resistors R3 and R4 by which it can be varied.

BRIEF DESCRIPTION OF THE DRAWINGS

These and other objects, features and advantages of the present invention will become apparent from the following detailed description and the appended drawing in which.

DETAILED DESCRIPTION OF THE PREFERRED EMBODIMENT

Figure 1:
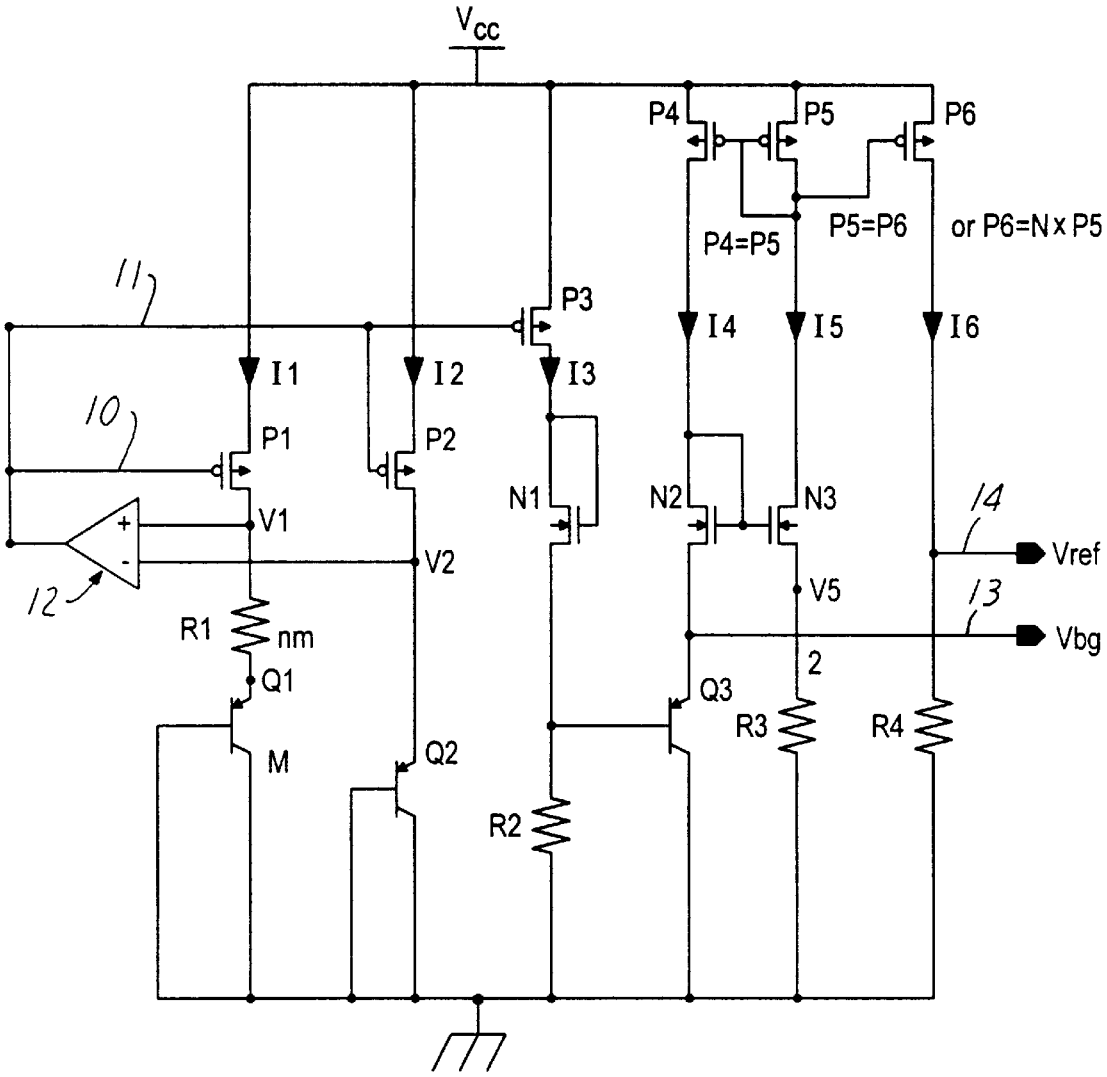
FIG. 1 is a simplified schematic of a voltage reference circuit, exclusive of the start up circuit, for producing a TI reference voltage in accordance with the present invention.

The present invention is directed to providing a voltage reference circuit that can be used to generate various selected reference voltage values with temperature independence, and embodies an improved circuit architecture combining a commonly used band-gap voltage reference circuit with a cascode current mirror to cancel the temperature coefficient of the preferred reference voltage.

In the preferred embodiment shown in FIG. 1, the circuit includes a combination of CMOS and bipolar transistors and a number of resistors connected between a supply voltage $V_{CC}$, typically of a value of 3.3 or 5 V, and ground. The band-gap voltage reference circuit portion involves three PMOS transistors, P1, P2, and P3, connected to supply voltage $V_{CC}$ and with their gates coupled to operational amplifier 10 and 11. P1 and P2 are also coupled to an operational amplifier 12 and respectively to resistor R1 and PNP transistor Q1, and PNP transistor Q2, which transistors have their bases grounded. P3 is connected between supply voltage $V_{CC}$ and NMOS transistor N1, which is coupled to ground through resistor R2 and the base of PNP transistor Q3. (Transistor 11 can be replaced with a resistor). The band-gap voltage reference $V_{BG}$ output 13, typically of a value of about 1.26 V, is connected via the emitter of PNP transistor Q3.

The cascode current mirror portion of the circuit for outputting the selectable voltage reference $V_{REF}$ includes a pair of matching PMOS transistors P4 and P5, connected between supply voltage $V_{CC}$ and a pair of matching NMOS transistors N2 and N3 with commonly connected gates. P4 and P5 have their gates commonly connected to the gate of PNP transistor P6, which is connected between supply voltage $V_{CC}$ and the reference voltage $V_{REF}$ output 14 as well as to ground through resistor R4. Transistor N2 is coupled to band-gap voltage reference $V_{BG}$ output 13, and to ground through transistor Q3, while its matching transistor N3 is coupled to ground through resistor R3. As indicated the values of the matching sets of transistors are N2=N3 and P4=P5. The value of P6 may be equal to that of P5, or P5×N where N is an integer multiple related to the values of resistors R3 and R4, but in either event $0<V_{REF}<V_{CC}$.

An analysis of the band-gap voltage reference circuit portion shows that the grids of transistors P1, P2 and P3 are all connected to the amplifier 12 output terminals and thus their respective current I1, I2 and I3 are equal. Furthermore, based on the characteristics of the feedback operational amplifier, V1=V2.

Thus, $$VI = V_{BE1} + I_1 R_1 = V_2 = V_{BE2}$$

$$I_1 = \frac{V_{BE1} - V_{BE2}}{R_1} = I_2 = I_3$$

$$I_1 = M\, I_{so} e \frac{V_{BE1}}{V_T}$$

$$I_2 = I_{so} e \frac{V_{BE2}}{V_T}$$

$$V_{BE2} - V_{BE1} = \frac{V_{\ln M}}{R_1}$$

-continued $$I_1 = I_2 = I_3 = \frac{V_T \ln M}{R_1}$$

$$V_{BG} = V_{BE3} + I_3 R_2 = V_{BE3} + V_T\left(\frac{R_2}{R_1}\right)\ln M) \quad (1)$$

where, $V_{BE1}$, $V_{BE2}$ and $V_{BE3}$ are the base-emitter voltages of transistors $Q_1$, $Q_2$ and $Q_3$ and have negative temperature coefficients.

$V_T$ is the thermal voltage with a positive temperature coefficient.

ln is the natural logarithm.

M is the ratio of the emitter areas of PNP transistors $Q_1$ and $Q_2$.

$I_{SO}$ is the emitter unit area current dependant on the Si material used.

$V_{BG}$ is the band-gap reference voltage independent of temperature.

An analysis of the cascade current mirror circuit portion shows that voltages $V_{BG}$ and $V_5$ are equal. Moreover, their respective passing current $I_4$ and $I_5$ are equal.

In addition, due to the connection of grid terminal of P5 and P6, current $I_5$ and $I_6$ are equal. Based on the above relationship, the following equations can be derived.

$$I_5 = I_4 = I_6 = \frac{V_{BGT}}{R_3}$$

$$V_{REF}=I_6 X R_4 \text{ therefore, } V_{REF}=(V_{BG}/R_3)\ X\ R_4 \quad (2)$$

Based on equations (1) and (2), in the present invention novel circuit, the desired reference voltage $V_{REF}$ is a function of the temperature independent band-gap voltage $V_{BG}$ and is therefore also temperature independent. Its value is a function of the values of resistors $R_3$ and $R_4$ from which it can be varied.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the invention.

The embodiment of the invention in which an exclusive property or privilege is claimed are defined in the following claims.

What is claimed is:

1. A voltage reference circuit for generating various selectable voltage reference values with temperature independence, comprising:

a band-gap voltage reference circuit portion for producing a band-gap voltage reference $V_{BG}$ output; said band-gap voltage reference circuit portion comprises:

first, second, and third CMOS transistors, P1, P2, and P3, of one conductivity type, connected on one side to a supply voltage $V_{CC}$ and with the gates of P1, P2 and P3 coupled to the outputs of an operational amplifier and with P1 and P2 connected on the other side respectively to the inputs of an operational amplifier;

a first resistance R1 and a first bipolar transistor Q1 connected in series between said other side of P1 and ground, with the base and collector of Q1 connected to ground;

a second bipolar transistor Q2 having its emitter connected to said other side of P2 and its base and collector connected to ground;

a second resistance R2 having one end connected to ground;

a fourth CMOS transistor N1 of the other conductivity type, connected between the other side of P3 and the other side of said second resistance R2; N1 may optionally be a resistor;

a third bipolar transistor Q3 having its base connected between said fourth CMOS transistor N1 and said second resistance R2, its collector connected to ground, and its emitter connected to said band-gap voltage reference $V_{BG}$ output; and a cascode current mirror circuit portion, coupled to said band-gap voltage reference circuit portion, for outputting a selectable voltage reference $V_{REF}$ with the temperature coefficient of the selected voltage reference canceled, said cascode current mirror circuit portion comprises:

fourth, fifth, and sixth matched CMOS transistors, P4, P5, and P6, of said one conductivity type, connected on one side to said supply voltage $V_{CC}$ and with their gates commonly connected to the other side of P5;

second and third matching CMOS transistors N2 and N3, of the other conductivity type, respectively connected on one side to the other side of P4 and P5 and with their gates commonly connected to said other side of P4, and having the other side of N2 connected to said band-gap voltage reference $V_{BG}$ output;

a third resistance R3 connected between the other side of N3 and ground; and a fourth resistance R4 having one end connected to ground and the other end commonly connected to the other end of P6 and said selectable voltage reference $V_{REF}$ output.

2. A voltage reference circuit according to claim 1, wherein matched CMOS transistors P4, P5 have the same value, and matching CMOS transistors N2 and N3 have the same value.

3. A voltage reference circuit according to claim 1, wherein matched CMOS transistors P4 and P5 have the same value, and P6 has the value P5/N, where N is an integer multiple related to the values of resistors R3 and R4.

4. A voltage reference circuit according to claim 1, wherein the value of said selectable voltage reference $V_{REF}$ output is:

$$0<V_{REF}<V_{CC}.$$

5. A voltage reference circuit according to claim 1, wherein the value of said band-gap voltage reference $V_{BG}$ output comprises:

$$V_{BG}=V_{BE3}+V_T(\mathrm{R2/R1}\times l_n\ M) \quad (1)$$

where $V_{BE3}$ is the base-emitter voltage of bipolar transistor Q3, $V_T$ is the temperature coefficient voltage factor, ln is natural logarithm, and M is the ratio of the emitter areas of bipolar transistors Q1 and Q2; and wherein the value of said selectable voltage reference $V_{REF}$ output comprises:

$$V_{REF}=V_{BG}\times \mathrm{R4/R3} \quad (2).$$

* * * * *